US007701335B2

(12) United States Patent
Van Dongen et al.

(10) Patent No.: US 7,701,335 B2
(45) Date of Patent: Apr. 20, 2010

(54) THEFT DETERRENCE SECURITY SYSTEM

(75) Inventors: Charles C Van Dongen, Frankston (AU); Grover L Howard, III, Melbourne (AU); Lindsay A Champion, Vermont (AU); Stuart J Evans, Caulfield (AU); Evan D Evans, Mulwala (AU)

(73) Assignee: Evatayhow Holdings PTY Ltd., Victoria (AU)

( * ) Notice: Subject to any disclaimer, the term of this patent is extended or adjusted under 35 U.S.C. 154(b) by 593 days.

(21) Appl. No.: 11/723,311

(22) Filed: Mar. 19, 2007

(65) Prior Publication Data

US 2007/0247308 A1 Oct. 25, 2007

Related U.S. Application Data

(63) Continuation of application No. 10/524,625, filed as application No. PCT/AU03/00940 on Jul. 24, 2003, now abandoned.

(30) Foreign Application Priority Data

Jul. 24, 2002 (AU) ..... 2002950343

(51) Int. Cl.
*G08B 1/08* (2006.01)
*G08B 13/00* (2006.01)
*G08B 29/00* (2006.01)

(52) U.S. Cl. ..... 340/539.19; 340/568.2; 340/506; 340/538.15; 340/687

(58) Field of Classification Search ..... 340/539.19, 340/568.2, 506, 687
See application file for complete search history.

(56) References Cited

U.S. PATENT DOCUMENTS

| | | | |
|---|---|---|---|
| 4,264,960 | A | 4/1981 | Gurr |
| 4,429,299 | A | 1/1984 | Kabat et al. |
| 4,446,458 | A | 5/1984 | Cook |
| 4,703,306 | A | 10/1987 | Barritt |
| 5,039,980 | A | 8/1991 | Aggers et al. |
| 5,767,771 | A | 6/1998 | Lamont |
| 6,005,476 | A | 12/1999 | Valiulis |
| 6,111,504 | A | 8/2000 | Packard et al. |
| 6,542,076 | B1 | 4/2003 | Joao |

FOREIGN PATENT DOCUMENTS

| | | | |
|---|---|---|---|
| EP | 206483 | A | 5/1986 |
| EP | 392872 | A | 4/1990 |
| GB | 2 155 708 | A | 9/1985 |
| GB | 2 259 172 | A | 3/1993 |
| GB | 2 286 277 | A | 8/1995 |
| GB | 2 303 726 | A | 2/1997 |
| WO | WO 96/36953 | A | 11/1996 |
| WO | WO 01/57627 | A | 8/2001 |
| WO | WO 02/11093 | A | 2/2002 |

*Primary Examiner*—Donnie L Crosland
(74) *Attorney, Agent, or Firm*—Oliff & Berridge, PLC

(57) ABSTRACT

A security system for not enabling, enabling or disabling electrical devices for deterring theft, or preventing unauthorized use of such devices. The security system comprises a plurality of electrical devices which are operationally linked via a bi-directional communication medium, which may be via a mains power supply or a microwave or radiowave medium. Programmable means are provided for controlling operation of the operative parts of the electrical devices. The programmable means may have a signal transmitting and receiving means associated with it for transmitting and receiving control signals over the communication medium.

33 Claims, 9 Drawing Sheets

THEFT DETERRENCE SECURITY SYSTEM

This is a Continuation of application Ser. No. 10/524,625 filed Jan. 20, 2005, which in turn is a National Stage of PCT/AUO3/00940 filed Jul. 24, 2003. The disclosure of the prior applications is hereby incorporated by reference herein in its entirety.

TECHNICAL FIELD

The present invention relates to a security system for electrical devices for deterring theft of those devices. The invention is applicable, for example, to electrical devices for households, for example, appliances such as television sets, VCR or DVD players, radios, hi-fi systems, washing machines, microwave ovens, and the like. Generally, the invention is applicable to any electrical device that includes an operation controlling programmable means such as a microprocessor or PLD (programmable logic device).

A security system according to the invention may operate within a given environment (for example, a household or business) in respect of electrical devices that are connected to a mains (AC or DC) or other networked power supply system for that environment, wherein the power supply system provides a communication medium for the security system whereby control signals are transmitted/received via the mains power supply of an electrical device. However electrical devices that are otherwise powered, for example self-powered, and which can be operationally linked via a communication medium such as for example, a radio or microwave communication system, are also included within the scope of the invention. Such self-powered electrical devices include for example mobile (cellular) telephones, portable computers etc.

BACKGROUND

International patent application publication number WO 02/11093 AI discloses a theft deterrent system for mains powered appliances that incorporates a separate dedicated controller and one or more controlled appliances. The controller includes an automatic reset feature whereby, when left plugged in to the mains power supply, the controller will automatically transmit a reset signal to one or more appliances immediately after the mains power supply is restored to the controller following a mains power supply interruption. That is, operation of the reset feature occurs in the event of a mains power interruption and normal restoration thereof. For theft deterrence the appliance controller may include a motion sensing means and a battery which will prevent the automatic re-setting of the appliances should the controller be moved whilst the mains power is disconnected.

A problem with this known theft deterrent system is that it is of limited versatility because all theft or non-theft events upon which a consequential system action occurs are wholly dependent upon the controller, that is, the system primarily operates via control signals transmitted from the controller and received by the protected appliance(s) in a master-slave relationship. Thus, for example, the automatic reset feature, the context for operation of which is interpreted as a non-theft event, requires a power interruption to the controller but without disconnection of the controller from the mains. When there is disconnection of the controller from the mains, which is interpreted as a theft event, the automatic reset feature is disabled.

An object of the present invention is to provide a security system (or methods of operation, or program products) for not enabling, enabling or disabling electrical devices (for example, household appliances) of the system for deterring theft of such devices, which is more versatile than the above described known system. The present invention includes various aspects (see below), which generally include a feature that a bi-directional communication protocol is followed before an electrical device protected by the system either remains inoperable, or is enabled or disabled. Another object is to provide an embodiment wherein all the electrical devices of the system will be disabled upon the detection of an unauthorised event in respect of only one of those devices.

The discussion herein of the background to the invention is included to explain the context of the invention. This is not to be taken as an admission that any of the material referred to was known or part of the common general knowledge in Australia as at the priority date of any of the claims of the present application.

DISCLOSURE OF THE INVENTION

Most broadly, the invention is a security system for not enabling, enabling or disabling electrical devices for deterring theft of such devices which, equipment-wise, includes a plurality of electrical devices which are operationally linked via a bi-directional communication medium, each electrical device including a programmable means for controlling operation of the electrical device, each programmable means having a signal transmitting and receiving means associated therewith for transmitting and receiving control signals over the communication medium, wherein the programmable means of one of the electrical devices is programmed as a controller for the other electrical devices.

The electrical device which includes the programmable means that provides the controller may be a dedicated controller as such, or alternatively it may be an electrical device such as an appliance which includes a data entry facility for its programmable means, and wherein its programmable means is programmed both to operate the electrical device or appliance as such and to provide the controller functions for the security system. In one broad form, the security system may involve only two electrical devices (for example, a dedicated controller and a household appliance or two household appliances one of which provides the controller functions for the other), however more usually the security system will involve several electrical devices. The equipment of the security system and its programming may also be such that if an existing controller is de-activated, another of the electrical devices of the system may be activated to provide the controller functions.

According to a first aspect of the invention the controller programmable means and the programmable means of the other electrical device or devices are programmed for a request-on control signal to be sent from an electrical device to the controller upon restoration of power to that electrical device following a power interruption thereto, and for the controller to return a turn-on control signal only if power to the controller has remained uninterrupted, whereby that electrical device is enabled only if the controller has remained enabled.

This first aspect of the invention allows for an electrical device to be disconnected from and then reconnected to the security system without that occurrence being interpreted as an unauthorised or theft event. That is, that there has been no power outage at the controller is interpreted as the controller not having been tampered with. This, for example, allows an electrical appliance within a household to be relocated within that household and to automatically resume operation when power is reconnected. Of course, if the controller is not present or "on line" to receive the request-on control signal, the electrical device will not receive a return turn-on control signal and thus the electrical device will remain inoperable. Otherwise if there has been a power outage at the controller other consequences may follow. A preferable such consequence is that if an electrical device to which power is restored sends a request-on control signal to the controller and the controller does not recognise the requesting device, then the controller sends a turn-off control signal to all electrical devices on the system, whereby all the electrical devices of the system are disabled in the presence of one unauthorised electrical device.

Thus if, for example, an electrical device is stolen and is plugged into the thief's home having a similar security system, the electrical device will send out a request-on control signal to the controller and as a correctly coded controller will not be present, no turn-on control signal will be sent, thus the electrical device will remain inoperable. As a new electrical device is now on the thief's security system with a different security code (for example pin number), the thief's controller will deem stolen goods to be on the security system and send a global turn-off signal which then turns off all the appliances in the thief's house that have this security feature. All such devices will remain inoperable until an appropriate security code for that device is provided through the controller or the device is removed from the system and the local security code for the system is provided to the controller.

According to a second aspect of the invention, the controller programmable means and the programmable means of the other electrical device or devices are programmed for a roll-call control signal to be sent from the controller to the other electrical devices, and for the other electrical devices to respectively and in sequence return a 'present' control signal to the controller in response to receipt of the roll-call control signal. If a 'present' control signal is not returned by any electrical device, or is returned out of sequence, the controller will detect that a system change has occurred and commence a security check, for example a polling sequence as in the third aspect of the invention (which is described hereinbelow). This aspect of the invention allows for a security check of the whole security system to be implemented that keeps the control signals bandwidth to a minimum, which reduces possible interferences (noise) from the bi-directional communication medium. Preferably the controller is programmed for the roll-call control signal to be repeatedly randomly sent.

According to a third aspect of the invention, the controller programmable means and the programmable means of the other electrical device or devices are programmed for polling control signals to be sent from the controller to the other electrical devices upon restoration of power to the controller following a power interruption thereto, and for the other electrical devices to return request-on control signals to the controller in response to receipt of their respective polling control signals, and for the controller to then send turn-on control signals to the other electrical devices only if none of the other electrical devices are missing.

This third aspect of the invention also encompasses the controller programmable means and the programmable means of the other electrical device or devices being programmed for the polling control signals to be repeatedly sent from the controller to the other electrical devices. This feature provides an added level of security in that initiation of a security check of the whole security system is not dependent upon a power outage having occurred to the controller. The polling control signals may be repeatedly sent with random timing between each poll within a user defined maximum time window.

With the third aspect of the invention, if any of the electrical devices initially on the system are missing, the controller will not send a turn-on signal to the electrical devices. Thus changes to the security system by way of the absence of an initially present electrical device or the addition of an extra electrical device, possibly indicative of tampering with the system, for example re-location by a thief of all the electrical devices of a system including the controller to the thief's household and the thief seeking to activate some or all of the electrical devices within his own home which may include other electrical devices, will result in the stolen electrical devices not being enabled. Of course, if the changes to the security system are legitimate, a user merely needs to enter a security code into the controller to authorise the controller to turn-on the electrical devices.

Preferably with the third aspect of the invention, if an initially present device is missing, the controller sends turn-off control signals to all the electrical devices on the system whereby all the electrical devices of the system are disabled in the presence of one unauthorised electrical device or in the absence of a device that should be on the system.

Thus, in a theft situation for example where all the electrical appliances including the controller of a household are stolen and installed in another premises, the controller will immediately commence a poll by sending out polling control signals. If any other appliance having a similar security feature is detected, the controller will send out a global turn-off signal thereby disabling both the stolen and owned goods of the thief. Of course, if the changes to the security system are legitimate, a user merely needs to enter a security code into the controller to authorise the controller to turn-on the electrical devices.

Preferably, in any of the above aspects of the invention, the controller programmable means is programmed to send turn-off control signals to all the electrical devices after a predetermined period (hereinafter termed an automatic "time out" feature) unless a security code is entered into the controller prior to the end of the predetermined period. Thus, for example, in a situation where a thief steals all the electrical devices and the controller of a household and plugs them all into the mains power system at a different premises, and there are no additional security protected electrical devices in that premises, then the electrical appliances will initially be enabled (see the third aspect of the invention), but will then be disabled after a time period in the absence of the thief entering a correct security code into the controller.

The above preferred feature is suitable, for example, for use in the rental market wherein an appliance may be accorded a security code that lasts for a predetermined period of time and the appliance will be disabled after that time period unless another security code is set via a controller for the appliance.

According to a fourth aspect of the invention, a security system having various of the features as described above may be realised in respect of a single electrical device, wherein the electrical device includes a programmable means for controlling operation of the electrical device, and that programmable means is also programmed as a security controller for the electrical device. Thus, according to this aspect of the invention, an electrical device can act as its own security controller. Most preferably in this aspect of the invention, the programmable means is programmed for a turn-off control signal to be generated after a predetermined period unless a security code is entered into the controller prior to the end of the predetermined period.

This fourth aspect of the invention primarily serves as security for the rental market wherein the electrical device may be accorded a security code that lasts for a predetermined period of time (for example, the intended rental duration) and the electrical device will be disabled after that time period unless that or another security code (as may be appropriate) is entered into the controller portion of the programmable means.

Another preferred feature in relation to any of the above aspects of the invention is for the controller programmable means to be programmed to randomly, within a user defined maximum time window, send a stay-on control signal to at least one of the electrical devices, and for that electrical device to be programmed to turn-off if the stay-on signal is not received.

The roll-call or polling control signals of the second and third aspects of the invention and the stay-on control signal of the immediately preceding preferred feature may be randomly timed within a user defined maximum time window. This has an added security advantage in that there is no consistency in the signal timing over the communication medium thus rendering such signalling difficult to monitor or replicate by a would-be thief.

A further preferred feature is that the programming is such that whenever the operational status of an electrical device of the system is changed, for example an appliance is switched from a "standby" mode to "on", that change is communicated to the controller. Thus the controller may monitor not only the presence of electrical devices, but also their current operational statuses.

A security system according to the invention in its various aspects may also be part of a monitored security alarm system wherein the monitoring is typically at a remote centralised security concern or police station. Thus, for example, based on the roll-call operational scenario (the second aspect of the invention), if thieves are removing electrical devices from the security system in a monitored premises, this will be evident at the remote monitoring station in real time and security personnel can be despatched to the monitored premises and be forewarned about which devices have been removed from the security system.

The programming of the programmable means of the electrical device or devices of a security system according to the invention may be encrypted as known in the art for added security. Alternatively such encryption may be specifically developed for the present invention.

In the case of a security system according to the invention in its various aspects being based on a mains power supply system, the electrical device or devices of the system will not require its or their own respective dedicated power supplies, that is, all necessary power for both the normal operation of an electrical device and for its operation in the security system is supplied from the mains. However a security system according to the invention may operate in respect of electrical devices that include their own dedicated power supplies, for example, from a battery or batteries incorporated in each device, so long as a suitable communication medium (for example, radio or microwaves) operationally links the electrical devices to the system. The invention also includes a security system wherein one or some of the electrical devices thereof may be mains powered and another or others of the electrical devices may have their own internal power supply.

A security system according to the system may also have added versatility in that the programming can be such as to configure a given electrical device to be recognised by more than one controller, or a given controller can be configured to recognise a number of different security codes.

Another optional feature is that the programming can be such that the controller of a security system may be used to program the operation of one or more of the other electrical devices of the system. Thus for example, the system controller may be used to program a VCR to record a selected TV show whilst a home occupant is absent, or to switch on an air-conditioning unit at a selected time prior to the arrival of a house occupant.

An electrical device of a security system according to the invention may also be programmed for it to be automatically disabled after a predetermined time period, unless a security code is inputted. A predetermined time period may be several days such as for example will allow the electrical device to be sent to a repair shop for repairs.

Persons skilled in this art will appreciate that all of the above aspects of the invention, including its various preferred or optional features, which are described as embodied via hardware (that is, equipment) may alternatively or additionally be realised via methods of operation involving a plurality of electrical devices, or as program products for programming the electrical devices.

For a better understanding of the invention and to show how it may be carried into effect, an example thereof will now be described, by way of non-limiting example only, with reference to the accompanying drawings.

DETAILED DESCRIPTION

Figure 1:
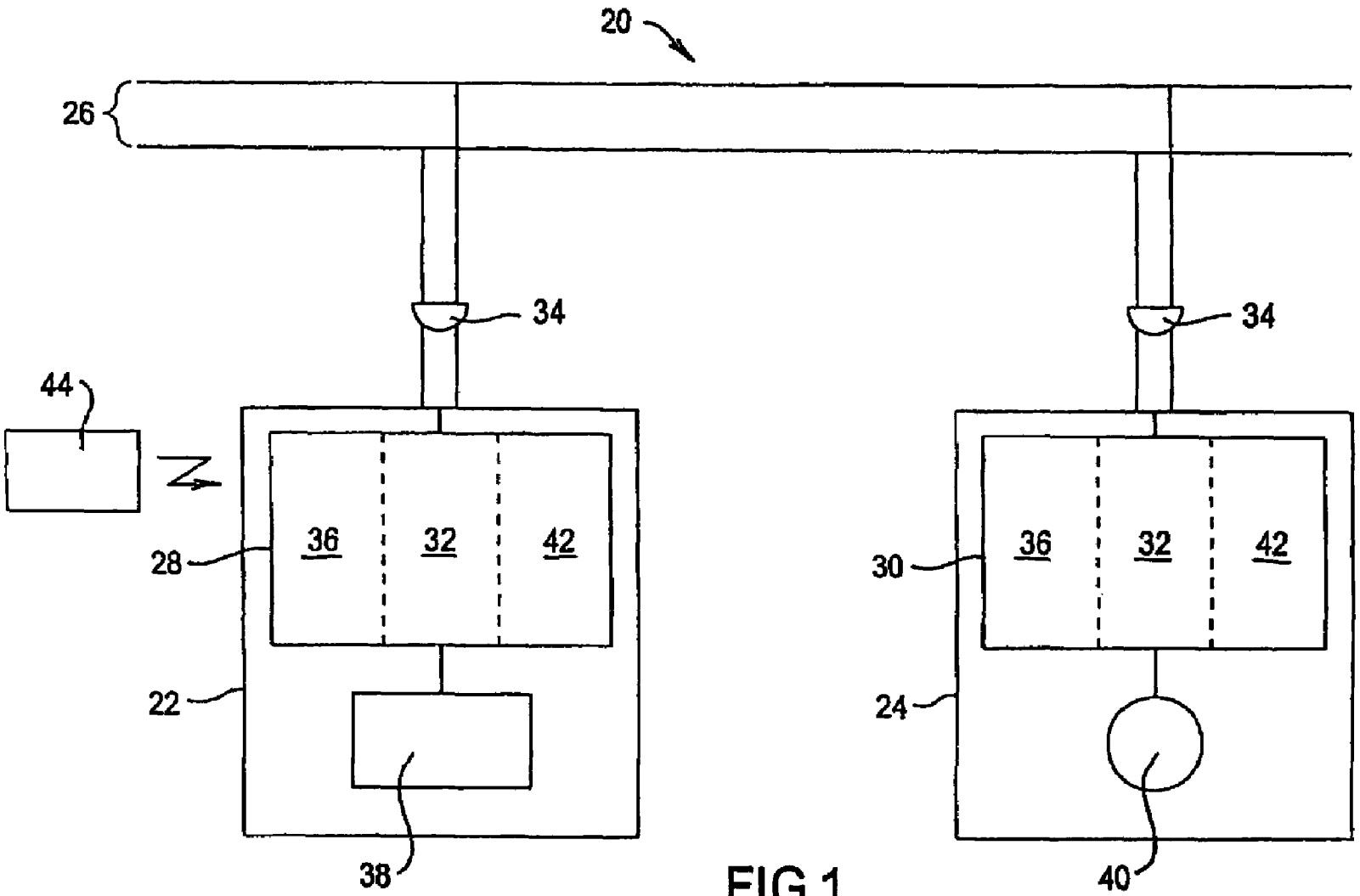
FIG. 1 schematically illustrates the equipment of a security system according to an embodiment of the invention.

A security system 20 (sea FIG. 1) according to an embodiment of the invention includes a plurality of electrical devices 22, 24 which are operationally linked via a bi-directional communication medium, in this embodiment an a.c. mains power supply 26. Each electrical device 22, 24 includes a programmable means, respectively 28, 30, each of which includes a signal transmitting and receiving means 32 for transmitting and receiving control signals over the communication medium (mains) 26. Each electrical device 28, 30 is connected to the mains 26 via a plug and socket 34, as is well known. The respective programmable means 28, 30 of the electrical devices 22, 24 are programmed (or programmable) for operation in the security system (schematically illustrated as part 36) and to operate the particular controlled components 38, 40 of the respective electrical devices 22, 24 (schematically illustrated as part 42). In the illustrated security system 20, electrical device 22 includes a data entry facility 44 for entering data into its programmable means 28. Facility 44 may be a key board that is hard wired to the electrical device 22 (for example as in a computer), or a remote device (for example as in a remote control device for a TV or VCR or DVD player). In the security system 20, electrical device 22 is programmed (or programmable) as a controller for the other electrical device 24 because it has data entry facility 44. The security system 20 may include more than two electrical devices for which the electrical device 22 is the controller.

Typically each electrical device 22, 24, etc will have an LCD device operationally linked to its programmable means 28, 30, etc for displaying messages associated with the operation of the security system, such as for example requesting entry of a security code (pin number), or a warning about an unauthorised system or electrical device status, or a normal system or electrical device status.

The programmable means 28 or 30 of the electrical devices 22, 24 may be an AMDEL Model No. AT 89C4051 microprocessor, or other microprocessor that is suitable for programming according to the requirements of the invention.

Figure 2:
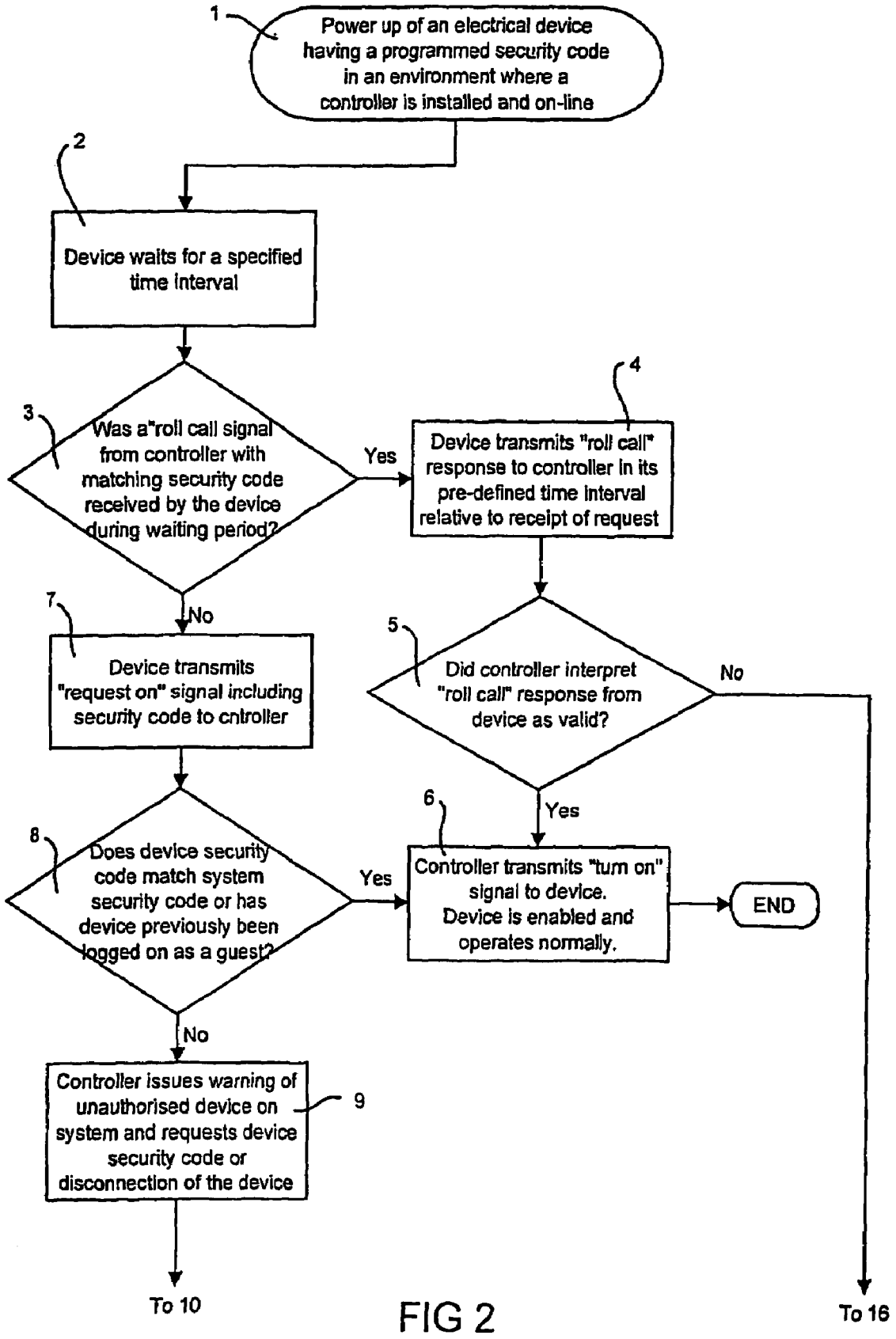
FIGS. 2 to 5 are flow charts that show programming and operating sequences for electrical devices of a security system according to embodiments of the invention.
Figure 2:
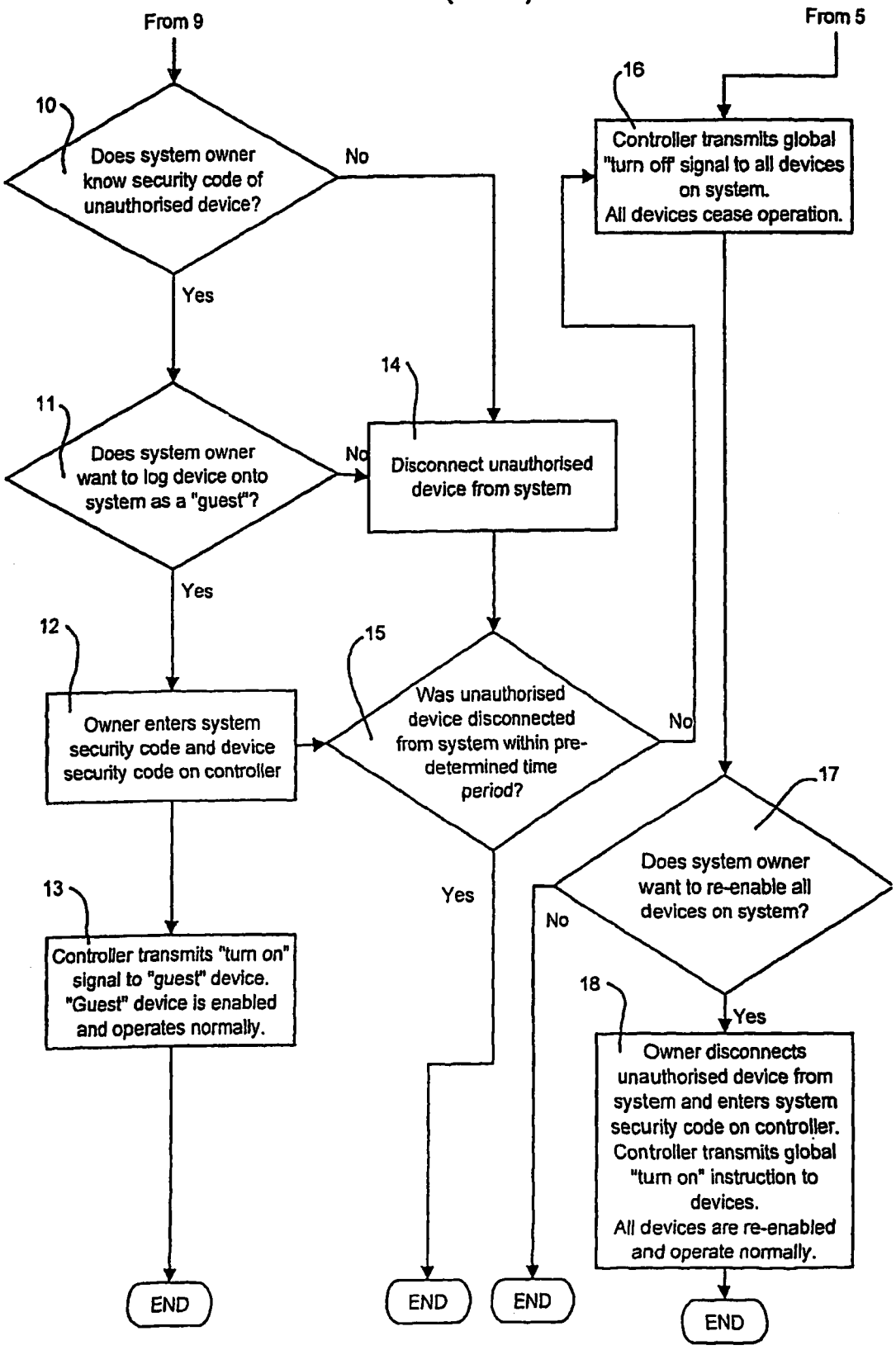

FIG. 2 is a flow chart (Flow Chart 1) that illustrates a sequence of possible events which can occur when an electrical device that has been programmed to be a controlled device 24 in a theft deterrence security system 20 herein described, is powered up in an environment where a programmed security controller 22 is installed and online. This flow chart illustrates a system where the controller uses a "roll call" technique to monitor devices on the system.

Immediately after power is applied to the device (Box 1), it waits for a pre-determined time interval (Box 2) to allow time for the receipt of a "roll call" or polling request from the controller (as in the second or third aspects of the invention). Such a request will occur if the controller was powered up at the same time as the device was powered up, eg. on restoration of mains power following a power failure. Although the device is powered up, it is not enabled at this point and will not work, but is capable of receiving and transmitting signals relating to security functions.

If a "roll call" request is received, (Box 3, YES response) the device transmits a response to the controller within a predefined time slot relative to the receipt of the request (Box 4). If the controller interprets the response as being valid according to its programmed criteria (Box 5 YES response, the controller transmits a "turn on" instruction to the device. The device is thereby enabled and will operate normally (Box 6). If the controller did not interpret the response from the device as valid (Box 5 NO response), it will transmit a global "turn off" instruction to all devices on the system, which then cease operation (Box 16).

If a "roll call" request was not received during the waiting period (Box 3 NO response), the device transmits a "request on" signal to the controller (Box 7) (as in the first aspect of the invention). This signal includes information which identifies the device, including its security code. If the controller recognises the device as one which belongs to this system, or which belongs to another system but is allowed to be on this system as a "guest" (Box 8 YES response), it will transmit a "turn on" instruction to the device (Box 6).

If the controller did not recognise the device (Box 8 NO response), the controller issues a warning of an unauthorised device on the system and requests that a security code for the device be provided or that the device be disconnected from the system (Box 9). If the system owner knows the security code for the device (Box 10 YES response) and wishes to log the device onto the system as a "guest" (Box 11 YES response), the owner must enter both the device security code and the system security code on the controller (Box 12). The controller then transmits a "turn on" instruction to the "guest" device, which is thereby enabled and operates normally.

If the system owner does not know the device security code (Box 10 NO response) or does not want to log the device onto the system as a "guest" (Box 11 NO response), the unauthorised device must be disconnected from the system (Box 14). If disconnection occurs within a predetermined time period (Box 15 YES response) no further action occurs and the system operates normally.

If the unauthorised device was not disconnected within the allowable time period (Box 15 NO response), the controller transmits a global "turn off" instruction to all devices on the system, which then cease operation (Box 16). If the system owner then wishes to re-enable all devices on the system (Box 17 YES response), this is possible at any time by disconnecting the unauthorised device and entering the system security code (Box 18).

Figure 3:
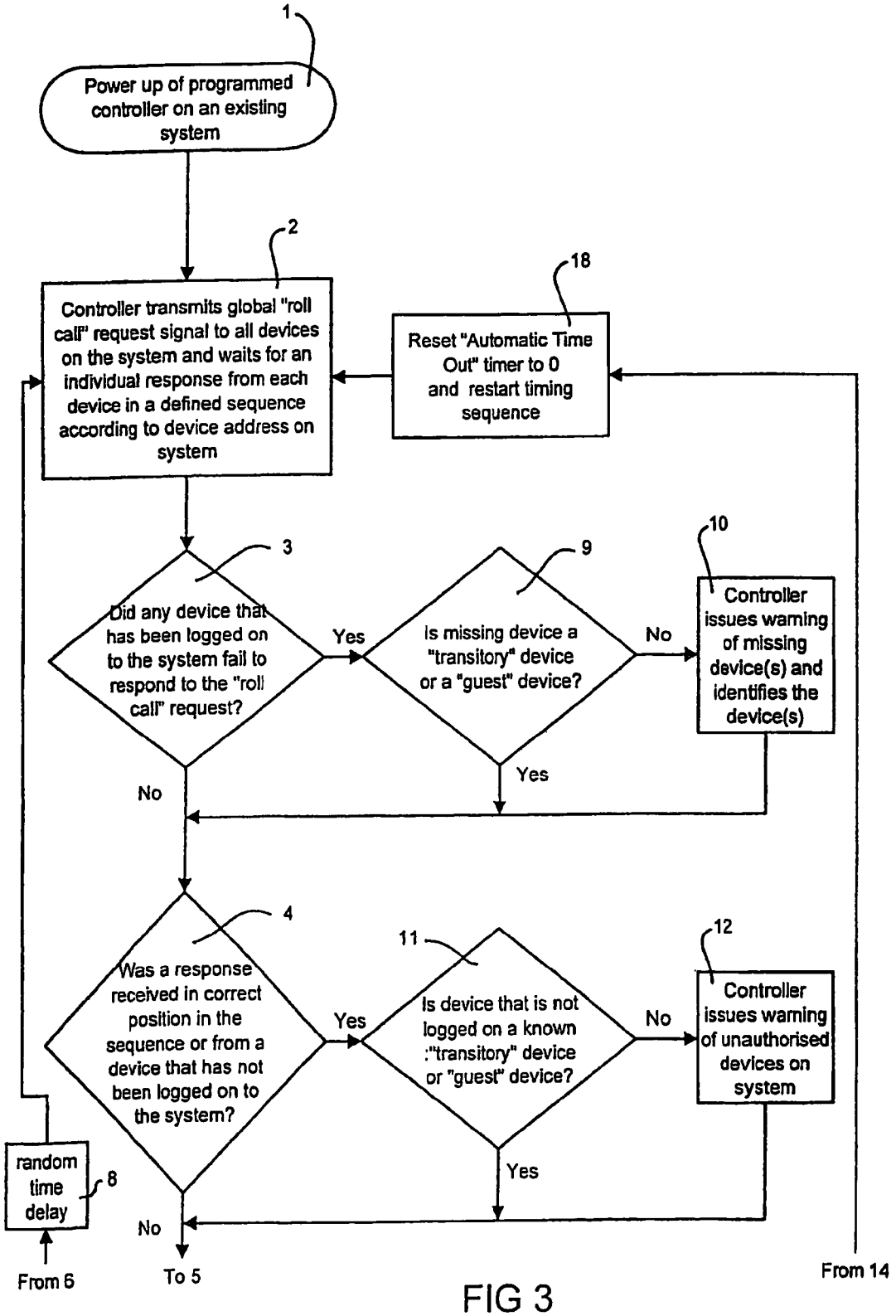
Figure 3:
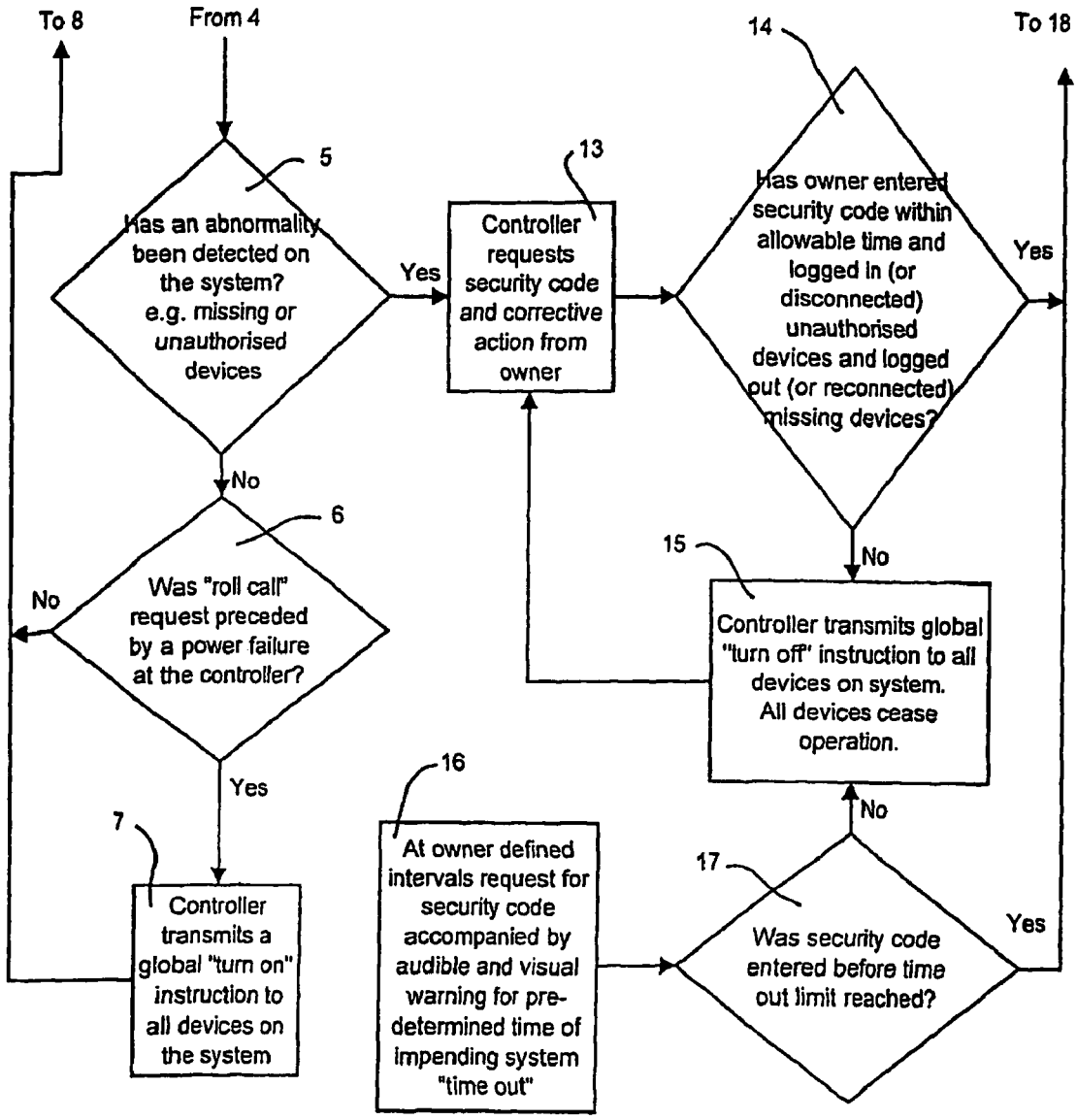

FIG. 3 is a flow chart (Flow Chart 2) that illustrates a sequence of possible events which can occur when an electrical device that has been programmed to be a controller 22 of a theft deterrence security system 20 herein described is powered up and remains on-line, in an environment where it is monitoring and controlling the security functions of other programmed devices 24. This flow chart illustrates a system where the controller uses a "roll call" technique to monitor devices on the system.

Immediately after power is applied to the programmed controller (Box 1) it transmits a global "roll call" request to all devices on the system, and waits for a response from each device in a defined sequence according to its address on the system (Box 2) (as in the second aspect of the invention).

If no devices that are logged onto the system failed to respond (Box 3 NO response) and no replies were received in an incorrect sequence, or from devices not logged onto the system (Box 4 NO response) the controller deems that there is no abnormality on the system (Box 5 NO response). If the "roll call" request was preceded by a power failure at the controller (Box 6 YES response) the controller then transmits a global "turn on" instruction to all devices (Box 7) since it can be assumed that the power failure had also shut down the other devices on the system and they will need to be turned on again. If the "roll call" request was not preceded by a power failure, but was one of the routine requests that occur at random time intervals (as preferred in the second aspect of the invention) (Box 6 NO response) no "turn on" instruction is transmitted, so as to avoid unnecessary signalling on the communications medium. In either case, after a random time delay (Box 8) a new "roll call" will be initiated (Box 2).

If any device that was logged on to the system at the previous roll call failed to respond (Box 3 YES response), the controller checks whether the missing device is either a "transistory" device or a "guest device". (A transistory device is one which has been programmed as such, and can be removed from the system and brought back without requiring any log off or log on action. A "guest" device is one which is part of another security system but the present system has been programmed to accept it, typically for a limited time period).

If the missing device is either transistory or guest (Box 9 YES response), the controller checks whether a reply was received in incorrect sequence or from any device not logged onto the system. If a response is received in an incorrect sequence or from a device that is not logged onto the system (Box 4 YES response) and the unlogged device is either transistory or a guest (Box 11 YES response), the system also deems that there is no abnormality on the system (Box 5 NO response).

If a missing device is not transistory or guest (Box 9 NO response), the controller issues a warning of a device missing from the system (Box 10). Similarly, if a device that is not logged on is not transistory or guest (Box 11 NO response) or a reply was received in an incorrect sequence, the controller issues a warning of unauthorised devices on the system (Box 12). If either or both warnings are issued, an abnormality exists on the system (Box 5 YES response) and the controller requests that the security code be entered (Box 13) and the abnormality be addressed within a predetermined time limit by logging in or disconnecting unauthorised devices, or by logging out or reconnecting missing devices. If the appropriate action is not taken within the allowable time limit (Box 14 NO response), the controller transmits a global "turn off" instruction to all devices on the system (Box 15). The controller then repeats the request for the security code (Box 15), and the cycle repeats until the abnormality is corrected.

The system also has an automatic "time out" feature which is initiated at owner defined intervals if the security code has not been entered at any time within this interval. When the "time out" limit is approaching, the controller issues an audible and visual warning accompanied by a request for the security code for a predetermined time (Box 16). If the security code is not entered before the time out limit has been reached (Box 17 NO response) the controller transmits a global "turn off" instruction to all devices on the system. If the security code was entered before the time out limit was reached (Box 17 YES response) the time out timer is reset to zero and the timing sequence recommences (Box 18). This timer is reset to zero at any other time the security code is entered, for example Box 14 YES response.

Figure 4:
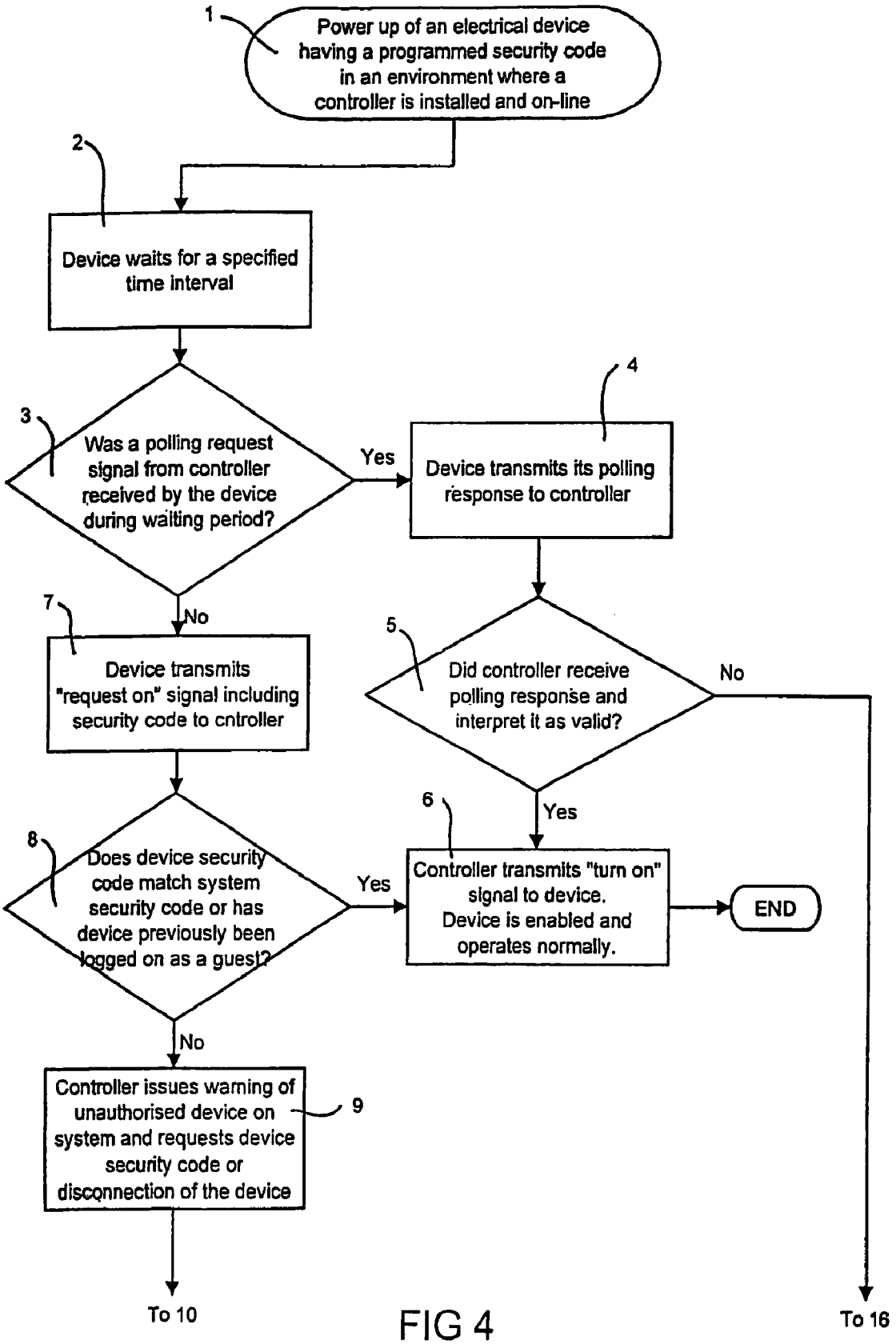
Figure 4:
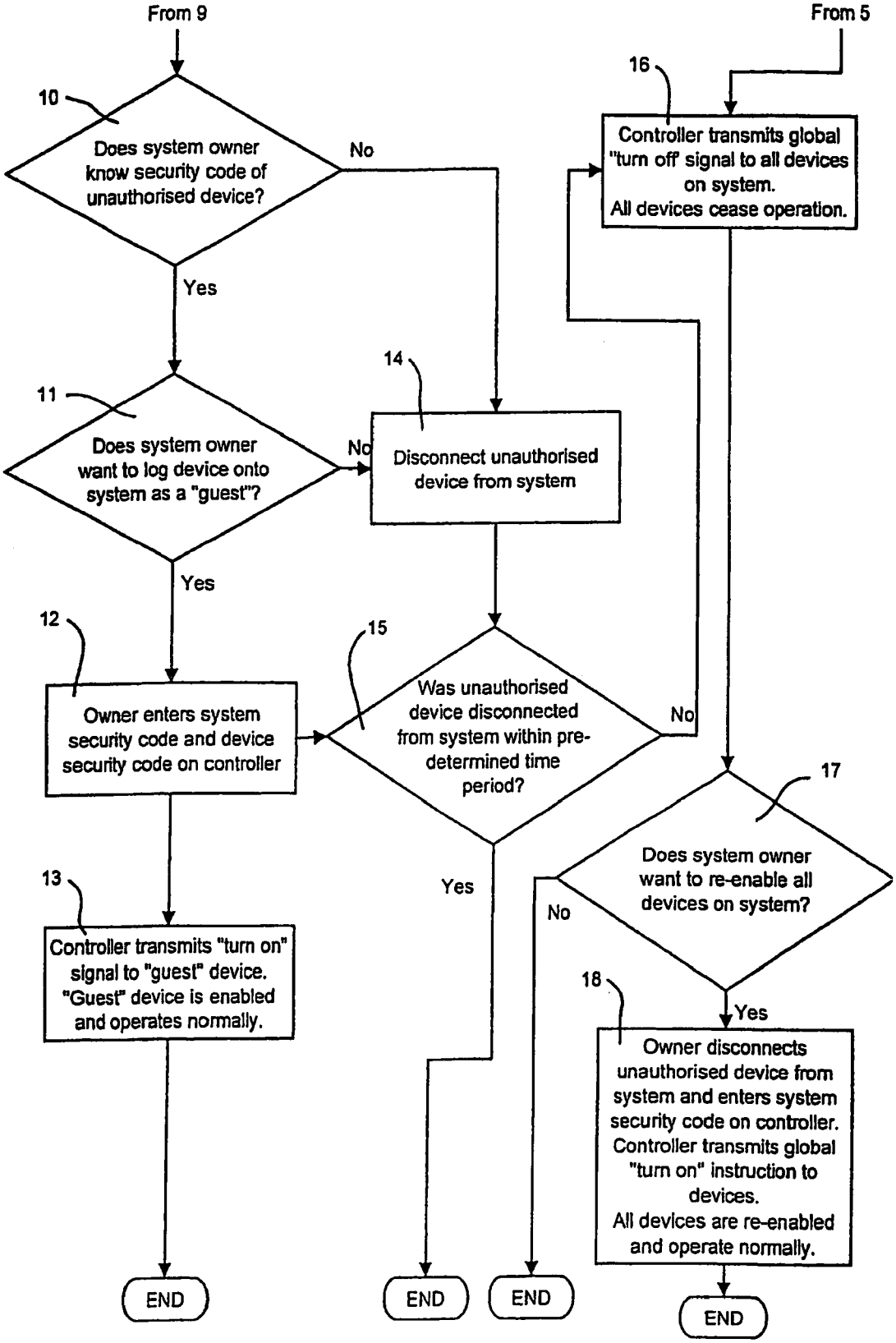

FIG. 4 (Flow Chart 3) illustrates a sequence of possible events which can occur when an electrical device that has been programmed to be a controlled device 24 in a theft deterrence security system 20 herein described, is powered up in an environment where a programmed security controller 22 is installed and on-line. This flow chart illustrates a system where the controller uses a polling technique to monitor devices on the system as in the third aspect of the invention.

Immediately after power is applied to the device (Box 1), it waits for a pre-determined time interval (Box 2) to allow time for the receipt of polling request from the controller. Such a request will occur if the controller was powered up at the same time as the device was powered up, eg. on restoration of mains power following a power failure. Although the device is powered up, it is not enabled at this point and will not work, but is capable of receiving and transmitting signals relating to security functions.

If a polling request is received, (Box 3, YES response) the device transmits its pre-programmed response to the controller (Box 4). If the controller interprets the response as being valid according to its programmed criteria (Box 5 YES response), the controller transmits a "turn on" instruction to the device. The device is thereby enabled and will operate normally (Box 6). If the controller did not receive the response from the device or did not interpret it as valid (Box 5 NO response), it will transmit a global "turn off" instruction to all devices on the system, which then cease operation (Box 16).

If a polling request was not received during the waiting period (Box 3 NO response), the device transmits a "request on" signal to the controller (Box 7). This signal includes information which identifies the device, including its security code. If the controller recognises the device as one which belongs to this system, or which belongs to another system but is allowed to be on this system as a "guest" (Box 8 YES response), it will transmit a "turn on" instruction to the device (Box 6).

If the controller did not recognise the device (Box 8 NO response), the controller issues a warning of an unauthorised device on the system and requests that a security code for the device be provided or that the device be disconnected from the system (Box 9). If the system owner knows the security code for the device (Box 10 YES response) and wishes to log the device onto the system as a "guest" (Box 11 YES response), the owner must enter both the device security code and the system security code on the controller (Box 12). The controller then transmits a "turn on" instruction to the "guest" device, which is thereby enabled and operates normally.

If the system owner does not know the device security code (Box 10 NO response) or does not want to log the device onto the system as a "guest" (Box 11 NO response), the unauthorised device must be disconnected from the system (Box 14). If disconnection occurs within a pre-determined time period (Box 15 YES response) no further action occurs and the system operates normally.

If the unauthorised device was not disconnected within the allowable time period (Box 15 NO response), the controller transmits a global "turn off" instruction to all devices on the system, which then cease operation (Box 16). If the system owner then wishes to re-enable all devices on the system (Box 17 YES response), this is possible at any time by disconnecting the unauthorised device and entering the system security code (Box 18).

Figure 5:
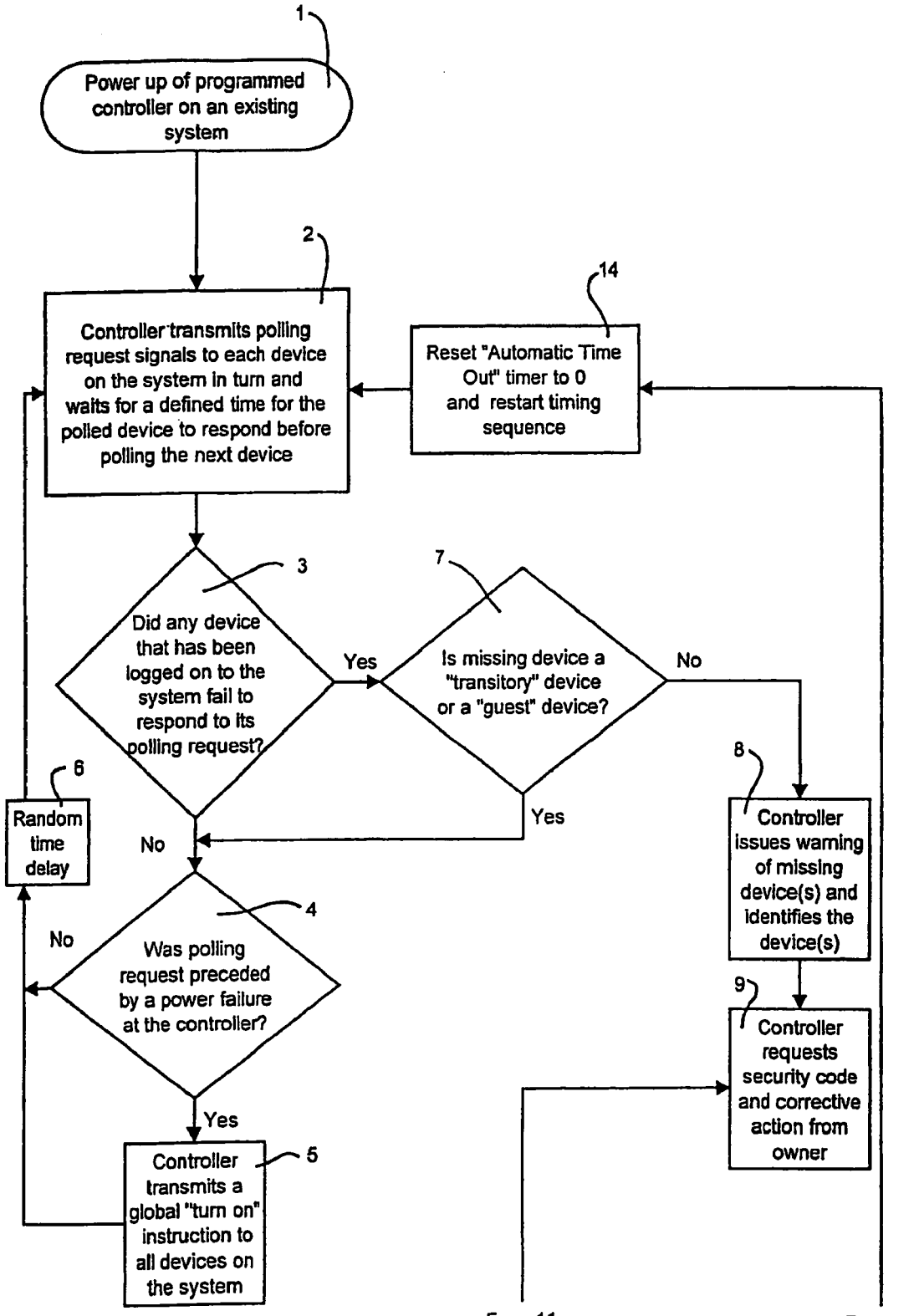
Figure 5:
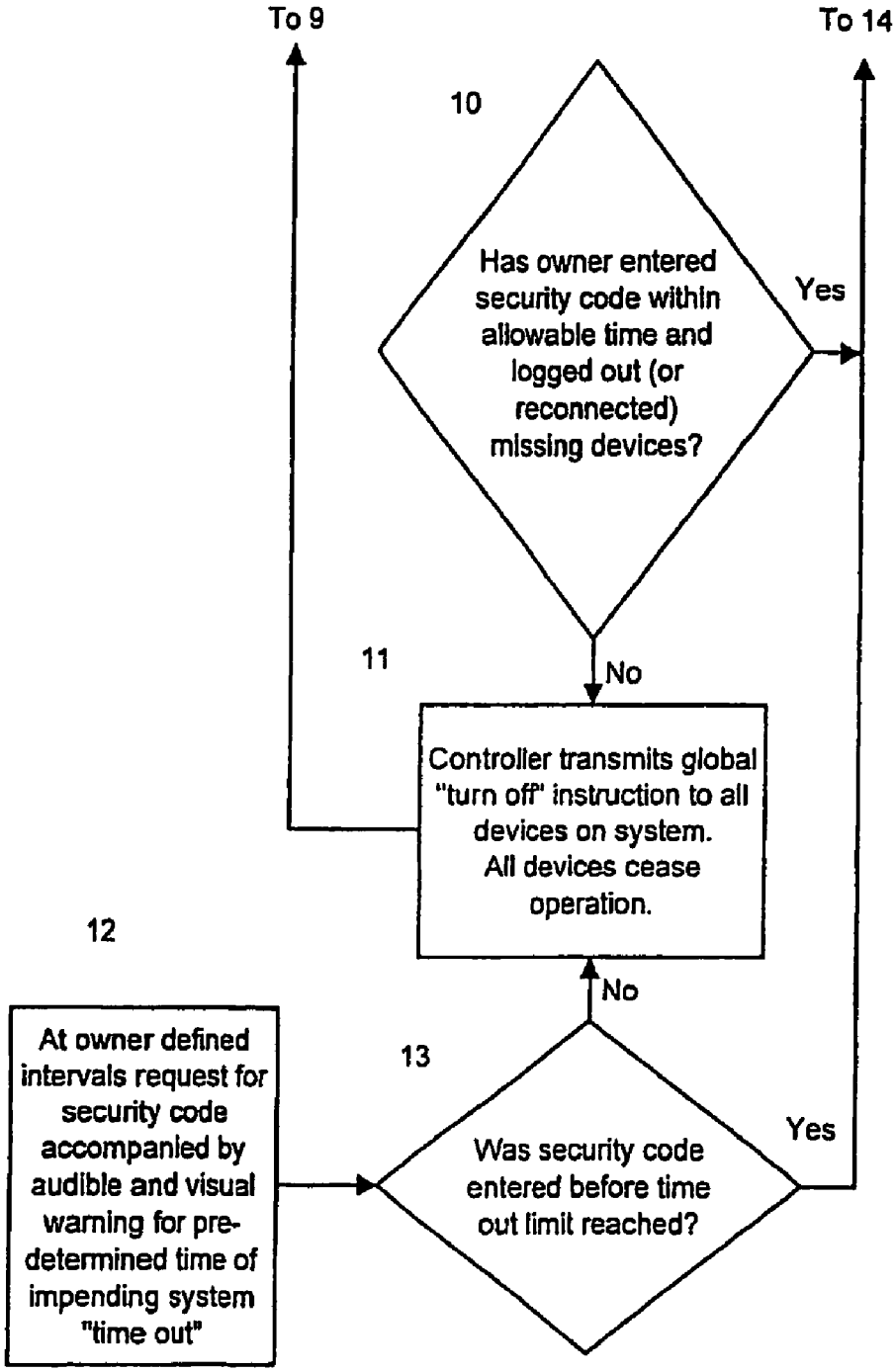

FIG. 5 (Flow Chart 4) illustrates a sequence of possible events which can occur when an electrical device 22 that has been programmed to be a controller of the theft deterrence security system 20 is powered up and remains on-line, in an environment where it is monitoring and controlling the security functions of other programmed devices. This flow chart illustrates a system where the controller uses a polling technique to monitor devices on the system.

Immediately after power is applied to the programmed controller (Box 1) it transmits polling requests in turn to each device on the system, and waits for a defined time for a response from the polled device before polling the next device (Box 2).

If no devices that are logged onto the system failed to respond (Box 3 NO response) and if the polling request was preceded by a power failure at the controller (Box 4 YES response) the controller then transmits a global "turn on" instruction to all devices (Box 5) since it can be assumed that the power failure had also shut down the other devices on the system, and they will need to be turned on again. If the polling request was not preceded by a power failure, but was one of the routine requests that occur at random time intervals (Box 4 NO response) no "turn on" instruction is transmitted, so as to avoid unnecessary signalling on the communications medium. In either case, after a random time delay (Box 6) a new polling request will be initiated (Box 2).

If any device that was logged on to the system at the previous poll failed to respond (Box 3 YES response), the controller checks whether the missing device is either a "transitory" device or a "guest device". (A transitory device is one which has been programmed as such, and can be removed from the system and brought back without requiring any log off or log on action. A "guest" device is one which is part of another security system but the present system has been programmed to accept it, typically for a limited time period.)

If the missing device is either transitory or guest (Box 7 YES response), the controller checks whether the polling request was preceded by a power failure (Box 4) and proceeds accordingly.

If a missing device is not transitory or guest (Box 7 NO response), the controller issues a warning of a device missing from the system (Box 8) and identifies the missing device(s). The controller then makes a request for the security code to be entered and for the abnormality to be addressed (Box 9). If the missing device is not logged out or reconnected within the allowable time limit (Box 10 NO response), the controller transmits a global "turn off" instruction to all devices on the system (Box 11). The controller then repeats the request for the security code (Box 9), and the cycle repeats until the abnormality is corrected.

The system also has an automatic "time out" feature which is initiated at owner defined intervals if the security code has not been entered at any time within this interval. When the "time out" limit is approaching, the controller issues an audible and visual warning accompanied by a request for the security code for a predetermined time (Box 12). If the security code is not entered before the time out limit has been reached (Box 13 NO response) the controller transmits a global "turn off" instruction to all devices on the system. If the security code was entered before the time out limit was reached (Box 13 YES response) the time out timer is reset to zero (Box 14) and the timing sequence recommences. This timer is also reset to zero at any other time the security code is entered, for example Box 10 YES response.

The invention described herein is susceptible to variations, modifications and/or additions other than those specifically described and it is to be understood that the invention includes all such variations, modifications and/or additions which fall within the scope of the following claims.

The invention claimed is:

1. A security system for deterring theft, or preventing unauthorized use of electrical devices, the security system comprising a plurality of electrical devices which are operationally linked via a bi-directional communication medium, each electrical device including a programmable component which is programmed for controlling operation of the electrical device and which is additionally programmed for providing security functions for the electrical device and for the security system, each programmable component having a signal transmitter and receiver associated therewith for transmitting and receiving control signals for implementing said security functions over the bi-directional communication medium, and a programmable controller which is programmed for providing security functions for all of the electrical devices of the security system, and which is operationally linked to each of the electrical devices via said bi-directional communication medium, wherein the security functions of the programmable controller and of the programmable components of the electrical devices are such that if a change in the security system occurs, being one of either an electrical device being removed or another electrical device being connected to the security system, the programmable controller detects that the change has occurred and initiates a security action.

2. A security system as claimed in claim 1, wherein said security action is a warning of an unauthorized change, which warning includes a request for a response by a human.

3. A security system as claimed in claim 2, wherein said request for a response by a human to the security action is a request that a security code be entered.

4. A security system as claimed in claim 3, wherein said request for a response by a human to the security action includes as an option, in a case where another electrical device has been connected to the security system, a request that said another electrical device be disconnected from the security system.

5. A security system as claimed in claim 2, wherein in the event that a requested response by a human is not satisfied within a predetermined period of time, said security functions include the programmable controller sending a global disabling control signal to all the electrical devices and initiating a further request for response by a human.

6. A security system as claimed in claim 5, wherein the request for further response by a human includes, where another electrical device has been connected to the security system, disconnection of said another electrical device from the security system and entry of a security code.

7. A security system as claimed in claim 1, wherein the security functions of the programmable controller and of the programmable components of the electrical devices include a roll-call control signal to be sent from the programmable controller to the electrical devices upon restoration of power to the programmable controller following interruption of power thereto, and for the programmable components of the electrical devices to respectively and in a predetermined sequence return a 'present' control signal to the programmable controller in response to receipt of the roll-call control signal, and for the programmable controller to then send an enabling signal to all of the electrical devices only if none of the electrical devices are missing and none of the 'present' control signals from the electrical devices was returned out of sequence.

8. A security system as claimed in claim 7, wherein the security functions of the programmable controller include the roll-call control signals to be repeatedly sent from the programmable controller to the electrical devices.

9. A security system as claimed in claim 8, wherein the roll-call control signals are repeatedly sent with random timing between each roll-call within a predetermined maximum time window.

10. A security system as claimed in claim 7, wherein if a 'present' control signal is not returned by any electrical device, or is returned out of sequence, the programmable controller will detect that a system change has occurred and initiate said security action.

11. A security system as claimed in claim 1, wherein the security functions of the programmable controller and of the programmable components of the electrical devices include polling control signals to be sent from the programmable controller to the electrical devices upon restoration of power to the programmable controller following a power interruption thereto, and for the electrical devices to return request-on control signals to the programmable controller in response to receipt of their respective polling control signals, and for the programmable controller to then send enabling control signals to the electrical devices only if none of the electrical devices are missing.

12. A security system as claimed in claim 11, wherein the security functions of the programmable controller include the polling control signals to be repeatedly sent from the programmable controller to the electrical devices.

13. A security system as claimed in claim 12, wherein the polling control signals are repeatedly sent with random timing between each poll within a predetermined maximum time window.

14. A security system as claimed in claim 1, wherein the security functions of the programmable controller and of the programmable components of the electrical devices include a request-on control signal to be sent from an electrical device to the programmable controller upon restoration of power to that electrical device following a power interruption thereto, and for the programmable controller to return an enabling control signal only if power to the programmable controller has remained uninterrupted and the programmable controller recognises the electrical device, whereby that electrical device is enabled only if the programmable controller has remained enabled, and the electrical device is authorised to be connected to the security system.

15. A security system as claimed in claim 14, wherein the security functions include that if an electrical device to which power is restored sends a request-on control signal to the programmable controller and the programmable controller does not recognise the requesting electrical device, then the programmable controller initiates security action which includes a request that the electrical device be disconnected from the system or that a security code be entered.

16. A security system as claimed in claim 15, wherein if the requested action is not carried out in an allowable time period, the programmable controller sends a disabling control signal to all electrical devices on the system, whereby all the electrical devices of the system are disabled in the presence of one unauthorized electrical device.

17. A security system as claimed in claim 16, wherein the security functions include for all the electrical devices to remain inoperable until a security code for that unauthorized electrical device is provided through the programmable controller or the unauthorized electrical device is removed from the security system and a local security code for the security system is provided to the programmable controller.

18. A security system as claimed in claim 1, wherein the security functions include the programmable controller sending disabling control signals to all the electrical devices after a predetermined period unless a security code is entered into the programmable controller prior to the end of the predetermined period.

19. A security system as claimed in claim 1, wherein the security functions include for the programmable controller to randomly, within a predetermined maximum time window, send a stay-on control signal to at least one of the electrical devices, and for that electrical device to be disabled if the stay-on control signal is not received.

20. A security system as claimed in claim 19, wherein the stay-on control signal is randomly timed within a predetermined maximum time window.

21. A security system as claimed in claim 1, wherein the bi-directional communication medium is a mains power supply system, whereby all necessary power for both the normal operation of an electrical device and for its operation in the security system is supplied from the mains, and whereby the control signals for determining said security functions are transmitted over the mains power supply system.

22. A security system as claimed in claim 1, wherein the security system involves electrical devices that include their own dedicated power supplies (for example, from a battery or batteries incorporated in each device), and the bi-directional communication medium is a wireless communication medium (for example, radio or microwaves).

23. A security system as claimed in claim 1, wherein the security system is interfaced with a general alarm system such that said security action includes the general alarm system initiating an alarm.

24. A security system as claimed in claim 23 wherein the general alarm system is a remotely monitored system and following initiation of a general alarm the programmable controller of the security system initiates a check of electrical devices by roll-call or polling, and if any electrical devices are missing that were present before the alarm was initiated, transmits a signal to the general alarm system.

25. A security system as claimed in claim 23 wherein the programmable controller of the security system is a controller associated with the general alarm system which is programmed both to operate the general alarm system and to provide the programmable controller security functions for the security system.

26. A security system as claimed in claim 1 wherein the security functions allow any of the electrical devices, other than the programmable controller, to operate as 'transitory' devices wherein they may be removed from, and returned to, the security system without the programmable controller initiating said security action, and wherein said 'transitory' devices are programmable to also operate in other compatible security systems.

27. A security system as claimed in claim 1 wherein the security functions include allowing compatible electrical devices that are not part of the security system, to operate as 'guest' devices on the system for a defined period of time without initiating a security action.

28. A security system as claimed in claim 1 wherein any of the electrical devices, other than the programmable controller, is programmable via the programmable controller to operate for a defined period of time in an environment where there is either no security system, or there is a security system in which the device is not programmed as either a 'transitory' device or a 'guest' device.

29. A security system as claimed in claim 1 wherein the security functions include the programmable controller able to program operation of one or more of the electrical devices of the security system.

30. A security system as claimed in claim 1 wherein the programmable controller is provided by the programmable component of one of the electrical devices which incorporates a data entry facility associated with its programmable component.

31. A computer program for a security system, the computer program providing for operation of the security system as claimed in claim 1.

32. An electrical device for a security system as claimed in claim 1, the electrical device including a programmable component programmed for controlling operation of the electrical device and which is additionally programmed for providing security functions for the electrical device and for the security system, the programmable component including a data entry facility, a signal transmitter and a signal receiver associated with the programmable component for transmitting and receiving control signals for implementing said security functions over a bi-directional communication medium.

33. An electrical device as claimed in claim 32 wherein the security functions for the electrical device include a disabling control signal to be generated after a predetermined period unless a security code is entered into the programmable component prior to the end of the predetermined period.

* * * * *